US006286340B1

(12) United States Patent
Yui

(10) Patent No.: US 6,286,340 B1
(45) Date of Patent: Sep. 11, 2001

(54) KNITTING METHOD FOR KNIT CLOTHING

(75) Inventor: Manabu Yui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 09/784,437

(22) PCT Filed: Aug. 27, 1999

(86) PCT No.: PCT/JP99/04676

§ 371 Date: Feb. 23, 2001

§ 102(e) Date: Feb. 23, 2001

(87) PCT Pub. No.: WO00/12799

PCT Pub. Date: Mar. 9, 2000

(30) Foreign Application Priority Data

Aug. 28, 1998 (JP) ..... 10-243354

(51) Int. Cl.[7] ..... D04B 7/10
(52) U.S. Cl. ..... 66/70; 66/176
(58) Field of Search ..... 66/70, 169 R, 66/69, 75.1, 68, 189, 169 A, 176, 175, 172 R, 171, 170

(56) References Cited

U.S. PATENT DOCUMENTS 3,640,097 * 2/1972 Betts et al. ..... 66/176
3,695,063 * 10/1972 Betts et al. ..... 66/176
3,702,068 * 11/1972 Betts et al. ..... 66/176
3,882,697 * 5/1975 Betts et al. ..... 66/176
4,197,724 * 4/1980 Robinson et al. ..... 66/176
5,203,185 * 4/1993 Okuno ..... 66/171
5,826,445 * 10/1998 Okamoto ..... 66/70
5,916,272 * 6/1999 Nonnenmacher et al. ..... 66/69
5,987,930 * 11/1999 Nakai ..... 66/69

FOREIGN PATENT DOCUMENTS 2309981 8/1997 (GB) .
9-273051 10/1997 (JP) .

* cited by examiner

*Primary Examiner*—Danny Worrell
(74) *Attorney, Agent, or Firm*—Arent Fox Kintner Plotkin & Kahn PLLC

(57) ABSTRACT

In a knitting method in which after a front body and a back body are knitted in a tube form, sleeves formed in a tube form and the both front and back bodies are joined on a flat knitting machine, knit clothing is knitted to form a good-looking armhole line, while preventing a possible yarn breakage when the sleeves as were completed in the knitting and the body are joined. In the knitting method in which after a tubular body, into which the first body and the second body are overlapped, and right and left tubular sleeves are knitted from hems to armpits, the sleeves and the body are joined, the first and second bodies and the right and left sleeves are knitted into one tubular body; a neckline is formed in at least one of the first and second bodies; the sleeves are shifted toward the body so that the body and the sleeves are joined; after completion of the course knitting for the sleeves and the first body, the remaining second body is knitted up to a shoulder line, during which the second body is shifted toward the sleeve and the second body and the sleeve which is formed on the same side with respect to the shoulder line are joined in such a manner that the stitches of the second body can appear on the front side of the stitches of the sleeve; the second body is sequentially knitted beyond the shoulder line, during which the second body is shifted toward the neckline and the second body and the sleeve which is formed on the opposite side to the joined sleeve with respect to the shoulder line are joined; and then the first body and the second body are joined at the shoulder.

2 Claims, 8 Drawing Sheets

KNITTING METHOD FOR KNIT CLOTHING

TECHNICAL FIELD

The present invention relates to a knit clothing knitting method using a flat knitting machine and, more particularly, to a knitting method in which after a front body and a back body are knitted into a tube form, sleeves knitted in the form of a tube and the both front and back bodies are joined on a flat knitting machine.

BACKGROUND ART

The applicant of this application previously proposed in Japanese laid open (unexamined) patent publication No. Hei 9-273,051 a knitting method in which front and back bodies and sleeves which are all knitted in the form of a tube are joined on the flat knitting machine so that the need for a sewing process, such as linking, can be eliminated or relieved. The publication discloses, as shown in FIGS. 1 to 3 (FIG. 1 is a diagram showing a knit clothing arranged on a flat knitting machine for the knitting; FIG. 2-A is a front view of a right half of a sweater 1 and FIG. 2-B is a rear view of the same; and FIG. 3 is a diagram showing the sweater 1 of FIG. 2 opened out along a shoulder line) the knitting method in which when the sleeves 4, 14 knitted in the form of a tube are joined to the front body 2*a* and the back body 2*b* which are knitted on a front needle bed and a back needle bed, respectively, and then the stitches in final courses of the front and back bodies 2*a*, 2*b* are joined in the shoulder, to knit the knit clothing with the sleeves 4, 14 and the front and back bodies 2*a*, 2*b* joined together, the front body 2*a* is knitted longer than the back body 2*b* in the shoulder and thereby the joining line 19 along which the front body 2*a* and the back body 2*b* are joined is formed at a place apart from the normal shoulder line 15 toward the back body, so as to allow knit clothing to have a variety of silhouettes without being restricted by the shoulder line 15.

In the knitting method of Japanese laid-open (unexamined) patent publication No. Hei 9-273,051, with the start of the sleeve 4 knitted in the direction indicated by the arrow Z in FIG. 3 being joined to the bodies 2*a*, 2*b*, the joining proceeds while the stitches of the next course are formed in each of the bodies 2*a*, 2*b* and the sleeve 4. However, in the final region W of the sleeve 4, the stitches of the next course are formed only in the front body 2*a*, and the sleeve 4 is joined to the front body 2*a* without any stitches being formed in the sleeve 4. Thus, during the joining of the sleeve to the front body 2*a*, the transferring of the stitches in the region W is repeated without any new stitches being formed in that region. Because of this, there is a possible yarn breakage when a weak knitting yarn is used for the knitting or when the knitting is performed with a knitting machine having fine gauges requiring the increased number of transferring.

In view of the disadvantages above, the present invention is intended to disclose an improved knitting method for knitting a knit clothing of the silhouettes disclosed by the above-noted publication of JP Laid-open (unexamined) patent publication No. Hei 9-273,051, while avoiding a possible yarn breakage even when a weak yarn is used for the knitting or when the knitting is performed with a knitting machine having fine gauges.

DISCLOSURE OF THE INVENTION

To solve the disadvantages noted above, the present invention provides a knitting method for knit clothing using a flat knitting machine having at least a pair of front and back needle beds arranged in opposition to each other, wherein after a tubular body, into which a first body and a second body are knitted in their overlapped state, and right and left tubular sleeves, each of which is knitted in the state in which both front and back sides are overlapped with each other, are knitted from hems to armpits, the sleeves and the body are joined, the knitting method comprising the steps:

1) that the first and second bodies and the right and left sleeves are knitted into one tubular body;
2) that a neckline is formed in at least one of the first and second bodies during the step 1;
3) that the sleeves are shifted toward the body so that the body and the sleeves are joined at the armhole;
4) that a course knitting for the sleeves and the first body is completed, followed by proceeding with a course knitting for the remaining second body;
5) that the second body for which the course knitting proceeds in the step 4 is knitted up to a shoulder line, during which the second body is shifted toward the sleeve and the second body and the sleeve which is formed on the same side with respect to the shoulder line are joined at their joining portion in such a manner that the stitches of the second body can appear on the front side of the stitches of the sleeve;
6) that the second body for which the course knitting proceeds is knitted beyond the shoulder line, during which the second body is shifted toward the neckline and the second body and the sleeve which is formed on the opposite side to the sleeve joined in the step 5 with respect to the shoulder line are joined; and
7) that the first body and the second body are joined at the shoulder.

According to the construction of the present invention mentioned above, in the process of the body and the right and left sleeves, which are each formed in a tubular form, being joined and knitted in the form of one large tubular body, a neckline is formed in one body, e.g. a back body, or in the other body, e.g. a front body and the sleeve is shifted toward the body to join the body and the sleeve. After completion of the course knitting for the sleeve and the back body, the course knitting for the front body proceeds. Then, the front body located between the neckline and the sleeve is shifted toward the sleeve in the process of the front body is knitted toward the shoulder line and the front sleeve portion formed on the same side as the front body with respect to the shoulder line is overlapped with the front body in such a manner that the stitches of the front body can appear on the front side of the stitches of the front sleeve portion. Sequentially, the front body is shifted toward the neckline in the process of the front body being knitted beyond the shoulder line and is joined to the back sleeve portion formed on the opposite side to the front body with respect to the shoulder line. Then, the back body and the front body as was completed in the joining to the sleeve are joined at the shoulder. With this knitting method, the front body extends into the back body beyond the shoulder line when the knit clothing is worn. As a result of this, the joining portion where one body and the other body are joined can be disposed apart from the shoulder line. This can produce an improved silhouette, preventing the design of the one body from being rendered discontinuous by the shoulder line. There is included the knitting step that when only the front body is knitted and joined to the sleeve, the front body, in which the stitches of the next course are sequentially formed, is shifted toward the sleeve to be joined to the sleeve. This can eliminate the need to transfer the stitches of the sleeve for which the stitches of the next course are not formed or can reduce the number of times of the transferring, and as such can prevent possible yarn breakage of the stitches of the sleeve. In addition, in the knitting process in which the sleeve is shifted toward the body to be joined to it, as well as in the knitting process in which the body is shifted toward the sleeve, the stitches of the body are superposed on the stitches of the sleeves in such a manner as to appear on the front side of the stitches of the sleeve and are joined thereto. This can produce an armhole line of good-appearance with the stitches of the body appearing on the front side of the stitches of the sleeves.

It is one of the characteristic features of the present invention that the step that the body is shifted toward the sleeve and the body and the sleeve are joined in such a manner that the stitches of the body can appear on the front side of the stitches of the sleeve includes the steps:

1) that the stitch of the sleeve at a lateral end thereof on the body side is transferred toward the stitch of the body at a lateral end thereof on the sleeve side, to superpose the stitch of the sleeve on the back side of the stitch of the body; and 2) that the body is shifted toward the sleeve.

According to the construction of the present invention, before the body is shifted toward the sleeve, the stitch of the sleeve at the lateral end thereof on the body side is superposed on the stitch of the body and, thereafter, the stitch of the body is transferred toward the sleeve, to thereby produce the armhole line with the stitches of the body appearing on the front side of the stitches of the sleeves, as is the case with the knitting in which the sleeve is shifted toward he body.

BEST MODE FOR CARRYING OUT THE INVENTION

Figure 1:
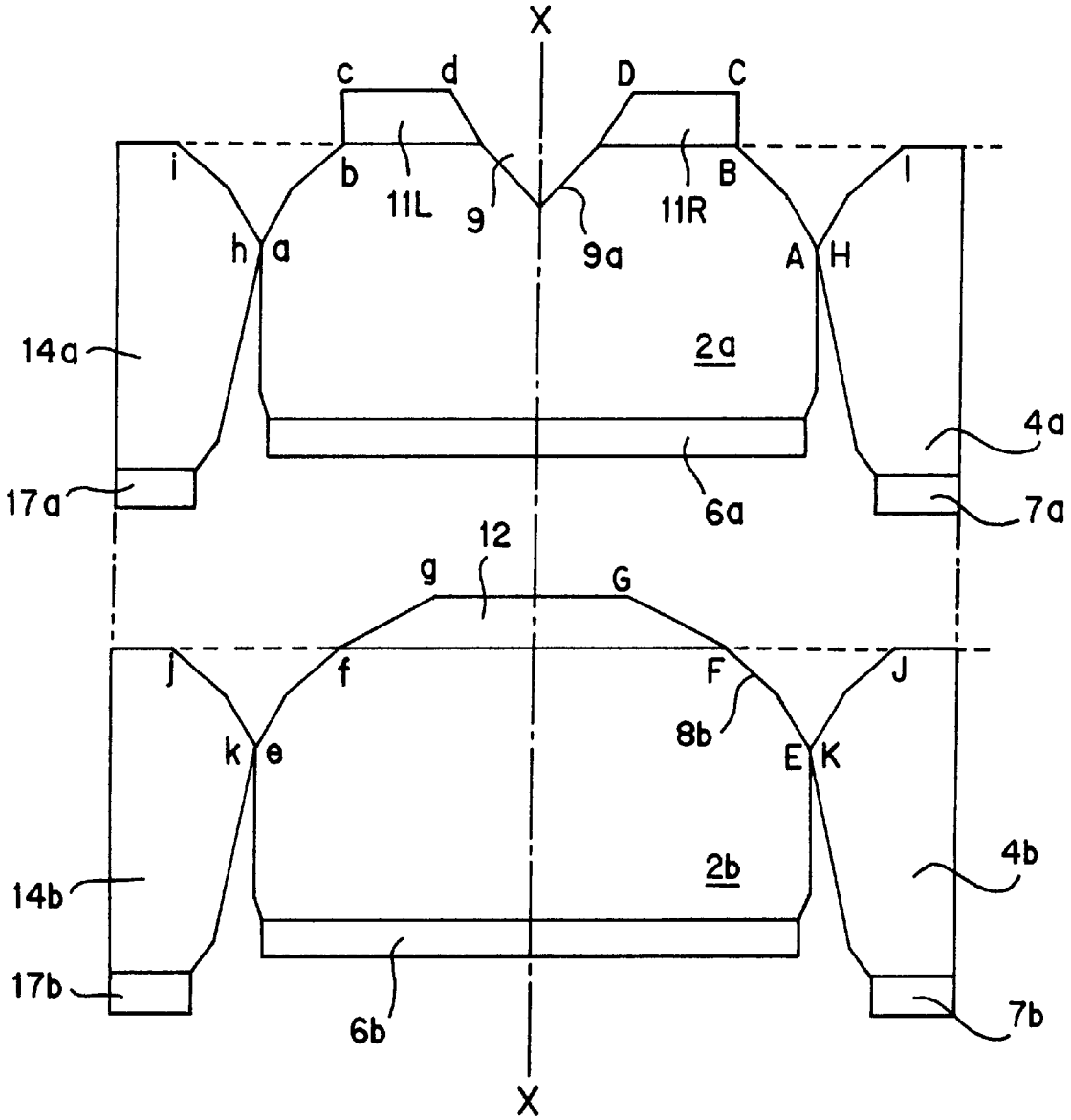
FIG. 1 shows parts of a sweater which are arranged on a flat knitting machine for the knitting, showing the design of a front body and two front sleeves and the design of a back body and two back sleeves.

An embodiment of the present invention will be described with reference to FIGS. 1 through 8. In the embodiment, the case of a plain sweater 1 with set-in sleeves being knitted as a knit clothing is taken as an example. Referring to FIG. 1, it shows parts of the sweater 1 arranged on a flat knitting machine for the knitting. The same diagram shows at an upper part thereof a front body 2*a* and front sleeves 4*a*, 14*a* that will appear on the front side when the sweater is worn. These are knitted with needles on a front needle bed of the flat knitting machine. The same diagram shows at a lower part thereof a back body 2*b* and back sleeves 4*b*, 14*b* that will appear on the back side when the sweater is worn. These are knitted with needles of a back needle bed. A line X—X is a centerline of the sweater 1, with respect to which the sweater 1 is symmetric. Reference numeral 9 designates a neckline and reference numerals 6, 7 and 17 designate rib-stitched hems.

Points A and H, points E and K, points a and h and points e and k designate joining points under the arms where the bodies 2 and the sleeves 4 and 14 are joined. In armholes 8*a*, *b*, the front body 2*a* and the front sleeves 4*a*, 14*a* are joined along the lines A-B, H-I, a-b and h-i, and the back body 2*b* and the back sleeves 4*b*, 14*b* are joined along the lines E-F, K-J, e-f and k-j. It should be noted that the front body 2*a* and the back body 2*b* are different in shape from each other at their parts 11, 12 extending beyond the points B, b F, f. Top lines I-J and i-j of the sleeves are joined to the lines B-C and b-c of the part 11 of the front body 2*a*, respectively. The front body 2*a* and the back body 2*b* are joined at the shoulder along the lines C-D, F-G, c-d and f-g.

Figure 2:
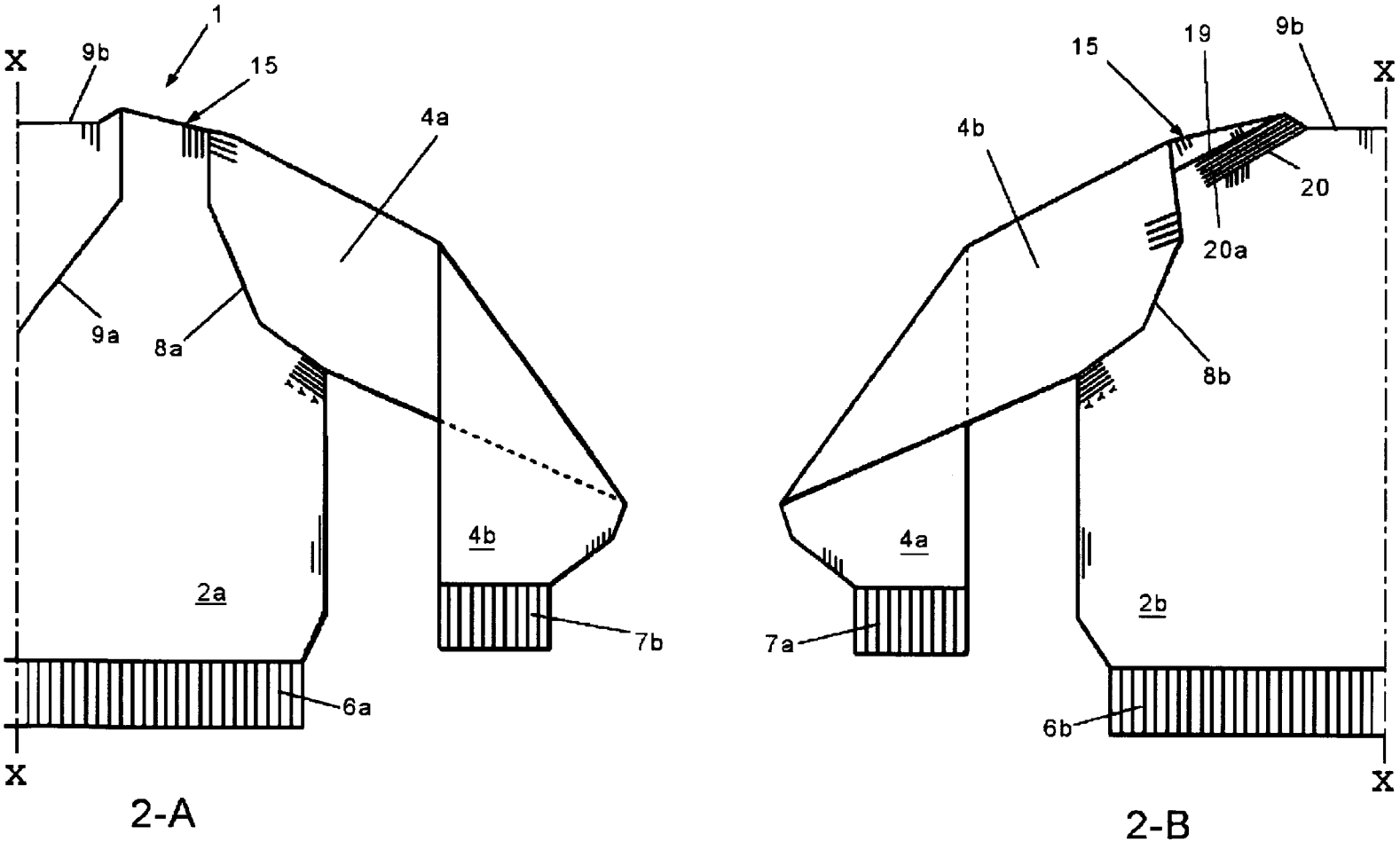
FIG. 2-A is a front view of a right half of the sweater and FIG. 2-B is a rear view of the right half of the sweater.
Figure 3:
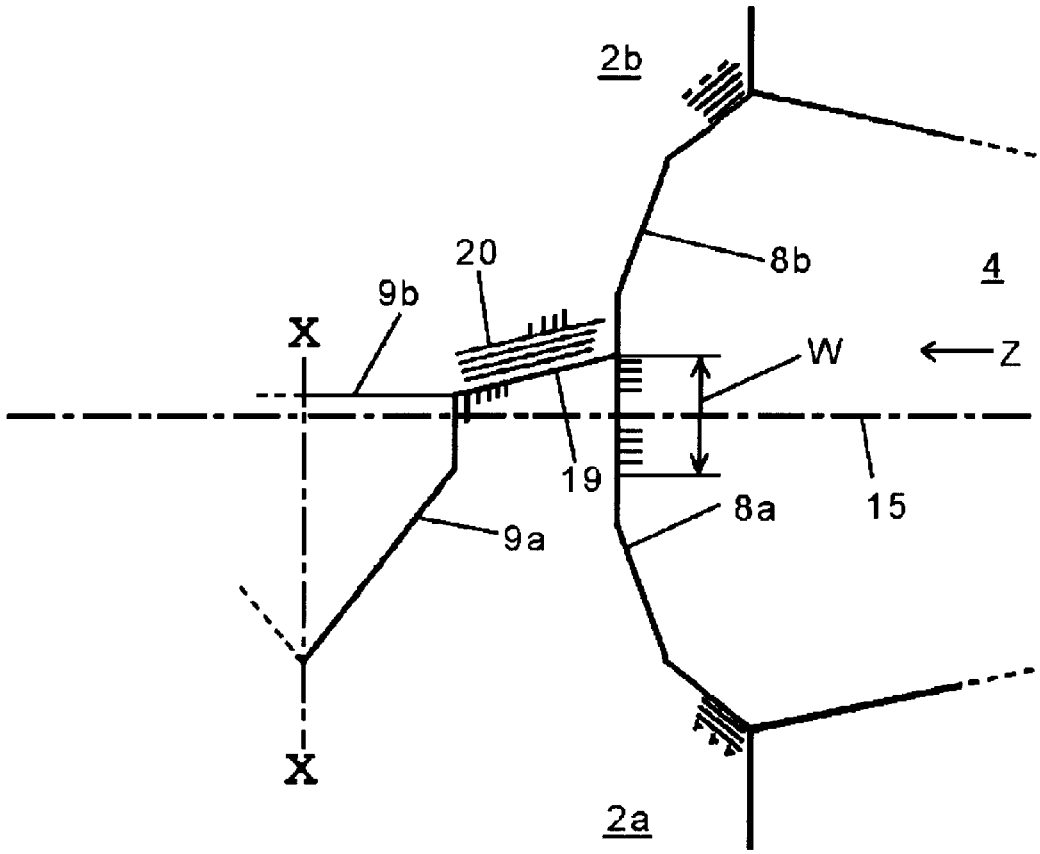
FIG. 3 is an illustration of a sweater opened out along a shoulder line.

Shown in FIG. 2 is the sweater 1 knitted on the basis of the parts of FIG. 1. FIG. 2-A is a front view of the right half of the sweater 1 and FIG. 2-B is a rear view of the right half of the sweater. Shown in FIG. 3 is the sweater 1 opened out along a shoulder line 15. As clearly seen from FIG. 3, a knitted fabric of the front body 2*a* comes in the back body 2*b* extending beyond the shoulder line 15. Formed in the joint portion 19 of the front and back bodies 2*a*, 2*b* are fashion lines 20 formed by a specified number of wale.

As aforementioned, it is the known knitting method that the sleeves 4, 14 and the body 2 are knitted in the form of tube by use of the flat knitting machine and also are joined together in the process of the knitting to thereby produce a nearly complete sweater at the completion of the knitting. In the following, description is made of the knitting performed by use of the flat knitting machine provided with transfer jack beds on which transfer jacks to transfer stitches between the transfer jacks and knitting needles of a pair of front and back needle beds over the needle beds are mounted with the same pitch as the pitch of the needles of the needle beds (hereinafter it is referred to as "the TR jack bed"). However, the present invention is not limited to the flat knitting machine of the type used in the following description. The present invention can also be practically used with a four-bed flat knitting machine having another pair of upper needle beds mounted on the pair of lower needle beds, a three-bed flat knitting machine in which the TR jack bed to enable the stitches to be transferred between the TR jack bed and either of the front and back needle beds is only arranged on either of the pair of front and back needle beds, and a two-bed flat knitting machine in which only the pair of front and back needle beds are arranged. Where the two bed flat knitting machine is used, for example, odd knitting needles of the needle beds are used for the front knitted fabric and even knitting needles are used for the back knitted fabric, and alternate needles of each of the front and back needle beds are used. This can always ensure empty needles for transferring the stitches of the knitted fabrics on the opposite needle beds, to allow both sleeves to be shifted laterally so as to be joined to the bodies.

The sweater 1 is started to be knitted from the rib-stitched hems 6*a*, 6*b*, 7*a*, 7*b*, 17*a*, 17*b*, which are knitted in the form of a tube, for example, by knitting a knitting yarn therearound. While in the illustrated embodiment, the tubular fabric is knitted by knitting a knitting yarn therearound, the tubular fabric may be knitted, for example, by knitting the front body and the back body by use of the respective yarn feeders, while crossing the knitting yarns used in the knitting of the respective bodies at both ends of their knitting regions. Also, while reference is given to the knitting of the sweater 1 as the knit clothing, the present invention can also be practically used for knitting another knit clothing such as a cardigan. After completion of the knitting of the rib-stitched hems, the bodies 2 and the sleeves 4, 14 are knitted up to the parts under the arms, while increasing the number of wale every time specified courses are knitted. The tubular body 2 and the tubular sleeves 4, 14 are joined at parts under the arms. Then, every time specified courses of the body 2 and sleeves 4, 14 are knitted from under the arms to the armholes, the sleeves 4, 14 are shifted toward the body 2, to superpose their stitches at the armholes 8*a*, 8*b*. Thus, the line A-B of the front body 2*a* and the line H-I of the front sleeve 4*a*; the line E-F of the back body 2*b* and the line K-J of the back sleeve 4*b*; the line a-b of the front body 2*a* and the line h-i of the front sleeve 14*a*; and the line e-f of the back body 2*b* and the line k-j of the back sleeve 14*b* are joined. As a result of this, the tubular sleeves 4, 14 are gradually reduced in knitting width and simultaneously the neckline 9*a* is formed.

In the following, the knitting way will be described with reference to FIGS. 4 through 8. As the knitting for joining the right sleeve 14 and the bodies 2*a*, 2*b* and the knitting for joining the left sleeve 4 and the bodies 2*a*, 2*b* are common with each other, except that they are the mirror images of each other, the description here is limited to the knitting for joining the left sleeve 4 formed at the right side of the line X—X of FIG. 1 and the bodies 2*a*, 2*b*. Also, as the knitting before the start of joining of the bodies 2*a*, 2*b*and the sleeve 4 and the knitting after the completion of joining of the bodies 2*a*, 2*b* and the sleeve 4 are disclosed by the above-noted Japanese laid-open (unexamined) patent publication No. Hei 9-273,051 and others, description is given on the knitting steps from the start of knitting for joining the bodies 2*a*, 2*b* and the sleeve 4 to the completion of joining of the bodies 2*a*, 2*b* and the sleeve 4. In FIGS. 4–8, the numeric characters on the left side designate the course numbers; FB designates the front needle bed, BB designates the back needle bed, FT designates the front TR jack bed and BT designates the back TR jack bed; and the horizontal arrows indicate the traveling direction of a yarn feeder 21 and the vertical arrows indicate the transferring direction of stitches.

Figure 4:
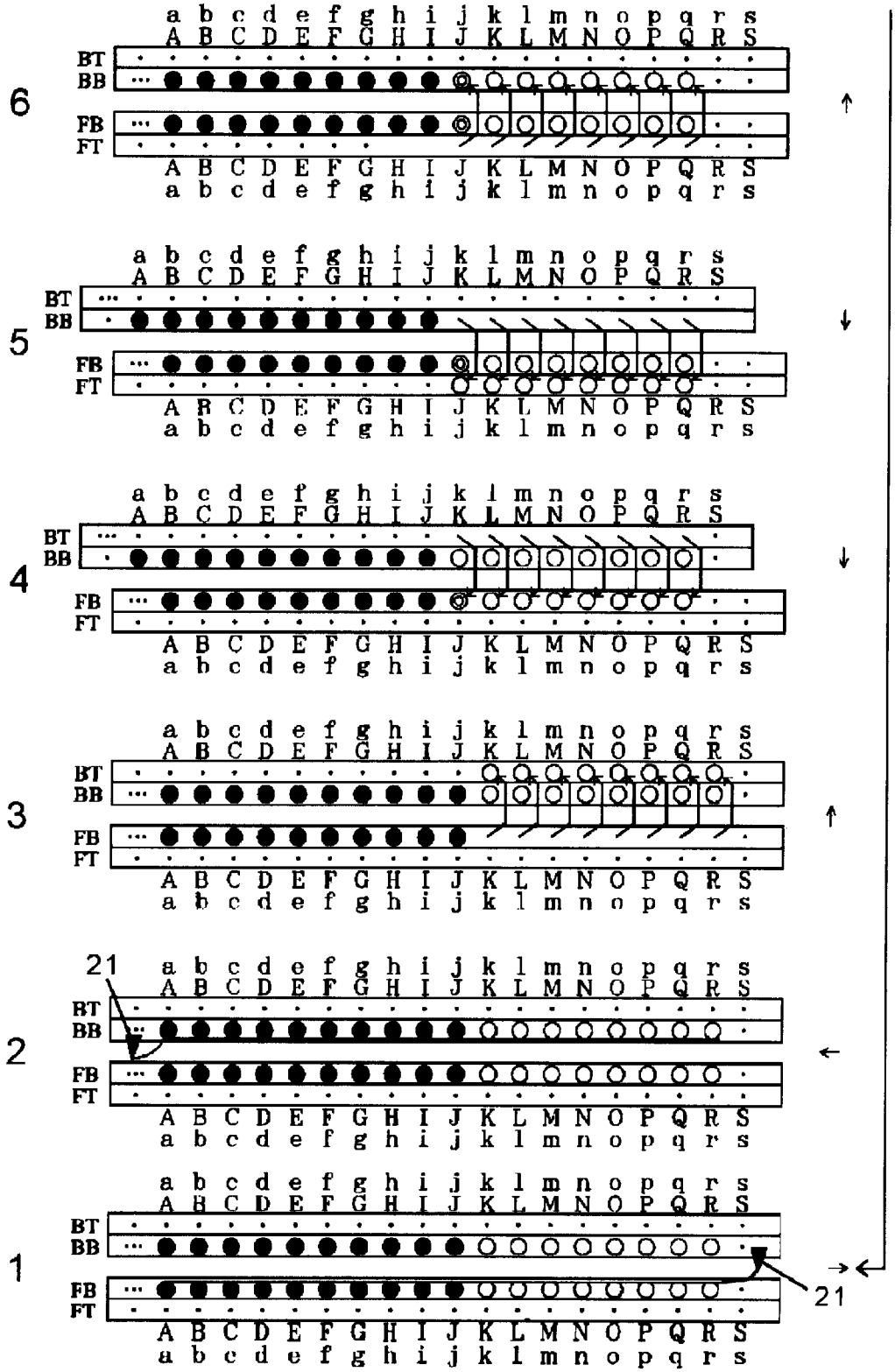
FIG. 4 is an illustration of knitting courses for the part where the sleeve is joined to the body while it is knitted.
Figure 5:
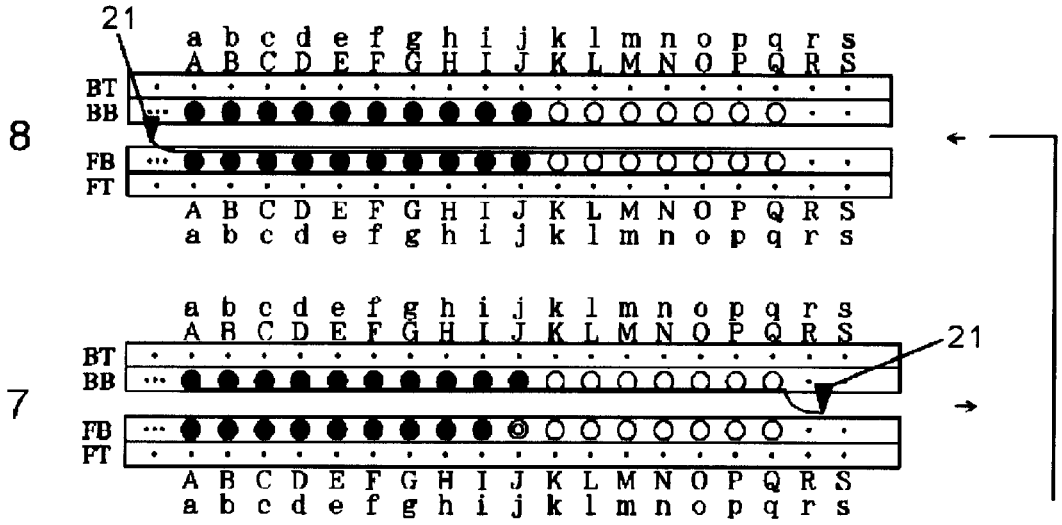
FIG. 5 is an illustration of knitting courses for the part where the sleeve is joined to the body while it is knitted.

With reference to FIGS. 4 and 5, description is first given on the knitting for joining the line A-B of the front body and the line H-I of the front sleeve and the knitting for joining the line E-F of the back body and the line K-J of the back sleeve, for which the stitches of the next courses are formed in the respective bodies and sleeves, while joining the bodies and the sleeves. The course 1 of FIG. 4 shows the state just before the start of knitting for the joining, in which the stitches of the front body 2*a* are retained on the needles A-J of the front needle bed; the stitches of the back body 2*b* are retained on the needles A-J of the back needle bed; the stitches of the front sleeve 4*a* to be knitted on the front needle bed are retained on the needles K-R of the front needle bed; and the stitches of the back sleeve 4*b* to be knitted on the back needle bed are retained on the needles K-R of the back needle bed. In the course 1, a yarn is fed to the needles A-R of the front needle bed through the yarn feeder 21 used for the knitting of both of the bodies 2*a*, 2*b* and the sleeve 4, to form stitches of the next courses in the front body and the front sleeve 4*a*. In the course 2, the yarn is fed to the needles R-A of the back needle bed, to form stitches of the next courses in the back body 2*b* and the back sleeve 4*b*. From after the start of joining of the bodies 2*a*, 2*b* and the sleeve 4 to before the start of forming of the neckline 9, the yarn is fed in a loop to the front and back bodies 2*a*, 2*b* and the left and right sleeves 4, 14, so as to be knitted in the form of one tubular body. After the start of forming of the neckline 9, the yarn feeder 21 is sequentially reversed in course in the neckline 9 to knit it. In the course 3, in order to shift the sleeves toward the bodies, the stitches of the front sleeve are transferred to the TR jacks k-r of the back TR jack bed. In the course 4, after the back TR jack bed is racked leftwards by one pitch, the stitches of the front sleeve 4*a* are transferred to the front needle bed and thereby the stitch of the front sleeve 4*a* at the lateral end thereof on the body side is superposed on the back side of the stitch of the front body 2*a* retained on the needle J of the front needle bed (it is noted here that the side of the fabric knitted in a tube form being exposed out is defined as the front side of the fabric and the side of the knitted fabric being hidden inwards is defined as the back side of the fabric.). In the course 5, the stitches of the back sleeve 4*b* are transferred to the TR jacks j-q of the front TR jack bed. In the course 6, after the back TR jack bed is racked rightwards by one pitch, the back sleeve 4*b* is transferred to the back needle bed and thereby the stitch of the back sleeve 4*b* at the lateral end thereof on the body side is superposed on the back side of the stitch of the back body 2*b* retained on the needle J of the back needle bed, to join the bodies 2*a*, 2*b* and the sleeve 4. In the sequent course 7 of FIG. 5, the yarn is fed to the needles A-Q of the back needle bed, and in the course 8, the yarn is fed to the needles Q-A of the front needle bed, to form the stitches of the next courses in the bodies 2*a*, 2*b*. The knitting for joining and the knitting for forming of the stitches of the next courses in the bodies 2*a*, 2*b* and sleeve 4 as illustrated in the courses 3 through 6 are performed in a manner mentioned below. In an arm portion of the fabric from which the joining of the bodies 2*a*, 2*b* and the sleeve 4 is started, the knitting for the joining is performed once every time twelve courses are knitted. As the knitting for the joining moves toward the shoulder, it may be varied in frequency such as, for example, being reduced in frequency such as once every eight courses and once every four courses, while the bodies and the sleeves are joined. This enables the sleeves to be joined to the bodies at any selective angle.

Figure 6:
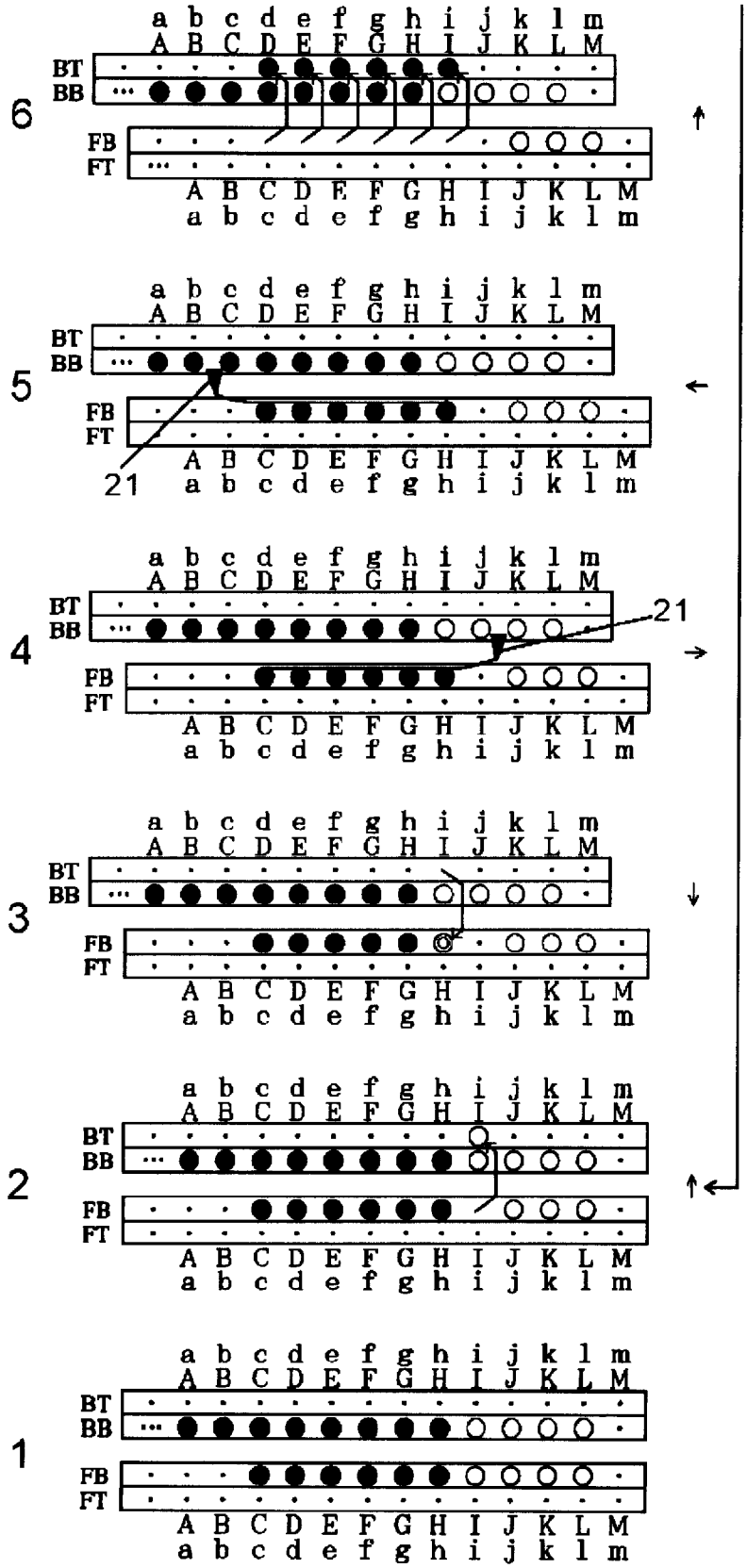
FIG. 6 is an illustration of knitting courses for the part where the sleeve as was completed in the knitting is joined to the body.
Figure 7:
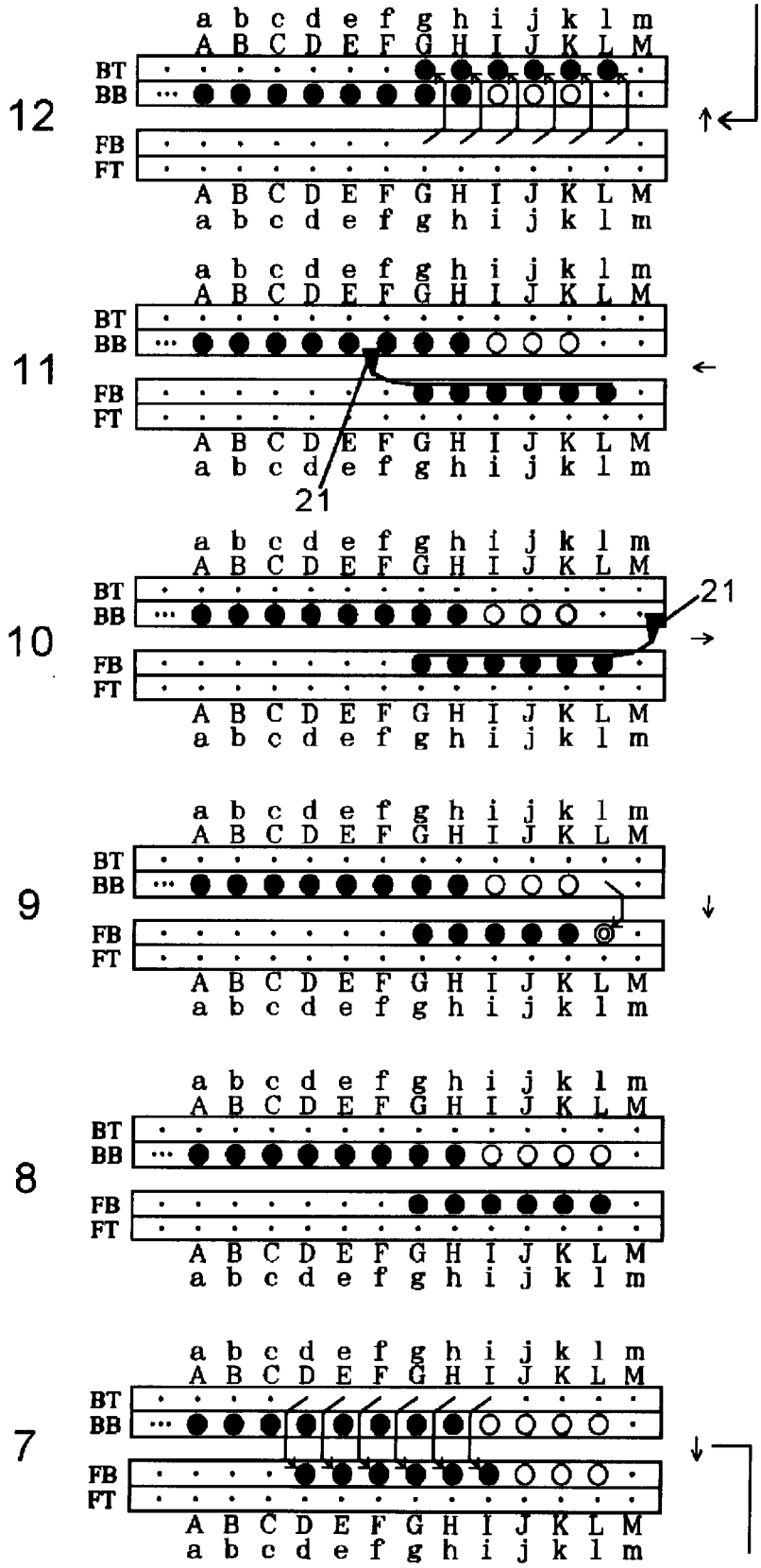
FIG. 7 is an illustration of knitting courses for the part where the sleeve as was completed in the knitting is joined to the body.
Figure 8:
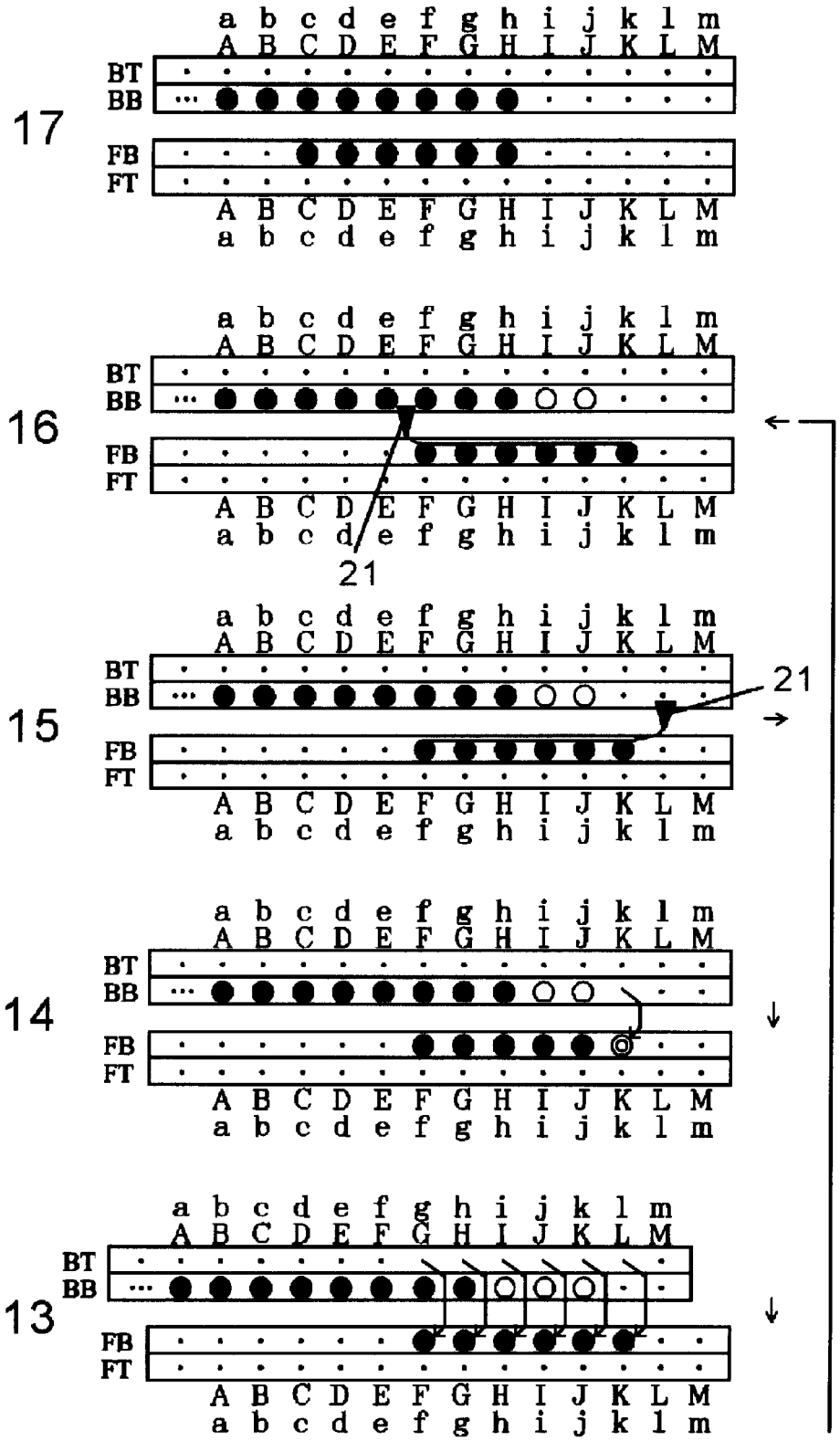
FIG. 8 is an illustration of knitting courses for the part where the sleeve as was completed in the knitting is joined to the body.

Next, with reference to FIGS. 6 through 8, description is given on the knitting process in the region W in which the line B-C of the front body and the line I-J of the front sleeve are joined after the completion of knitting of the courses of the sleeves. The course 1 of FIG. 6 shows the state in which the stitches of the sleeve 4 are reduced in number by the repetition of the knitting steps of FIGS. 4 to 5 and the stitches of the front sleeve 4*a* are retained on the needle I-L of the front needle bed and the stitches of the back sleeve 4*b* are retained on the needles I-L of the back needle bed. The neckline 9 is formed at the left side from the needle C of the front needle bed. In the neckline 9 forming portion of the fabric, the stitches in the corresponding portion to the neckline are in disengagement from the needles, so that the bodies formed on both sides of the neckline can be shifted to the opposite sides. In other words, the front body formed on the right-hand side of the neckline can be shifted toward the right sleeve 14 and the front body formed on the left-hand side of the neckline can be shifted toward the left sleeve 4. This can allow the front body 2*a* to be shifted toward the sleeve 4 to be joined to it, and as such can eliminate the need to transfer the stitches of the sleeve 4 in which the stitches of the next course are not formed. While in the illustrated embodiment, the neckline is formed in the front body 2*a* only, the neckline may be formed in the back body 2*b* as well in the same manner as in the front body 2*a*. In the course 2 of FIG. 6, the stitch of the front sleeve 4*a* at the lateral end thereof on the body side is transferred to the TR jack i of the back TR jack bed. In the course 3, after the back TR jack bed is racked leftwards by one pitch, the stitch is transferred to the needle H of the front needle bed and thereby the stitch of the front sleeve is superposed on the back side of the stitch of the front body 2*a* at the lateral end thereof on the sleeve side which is retained on the needle H, to join the body 2*a* and the front sleeve 4*a*. In the sequent course 4, the yarn is fed to the needles C-H of the front needle bed, to form the stitches of the next course in the front body 2*a*. In the course 5, after the yarn feeder 21 is reversed in course, the yarn is fed to the needles H-C of the front needle bed, to knit the front body 2*a*. In the course 6, newly formed stitches of the front body 2*a* are transferred to the TR jacks d-i of the back TR jack bed. In the course 7 of FIG. 7, after the back TR jack bed is racked rightwards by one pitch, the stitches are transferred to the needles D-I of the front needle bed, to bring the front body 2*a* and the front sleeve 4*a* into abutment with each other. As shown in the course 2 of FIG. 6 through the course 7 of FIG. 7, the knitting steps for joining the front body 2*a* to the front sleeve 4*a* formed on the same side with respect to the shoulder line 15 are repeatedly performed while the front body 2*a* is shifted toward the sleeve 4. This allows all the stitches of the front sleeve 4*a* to be joined to the front body 2*a*, as shown in the course 8 of FIG. 7 and, as a result of this, the joining of the front body 2*a* and the front sleeve 4*a* is completed up to the shoulder line.

Next, description is given on the joining process in which after the completion of joining the front body 2*a* and the front sleeve 4*a*, an extended part of the front body 2*a* that is formed to extend beyond the shoulder line 15 into the back body and the back sleeve 4*a* are joined. Although the front body 2*a* extended beyond the shoulder line 15 is allowed to join to the sleeve 4 by shifting the front body 2*a* toward the sleeve 4, since the sleeve 4 is knitted in the state in which the front sleeve 4*a* and the back sleeve 4*b* are folded back along the shoulder line, the front body 2*a* is shifted leftwards or toward the neckline and is joined to the back sleeve 4*b*. In the course 9, the stitch of the back sleeve 4*b* at the lateral end of the body is transferred to the needle L of the front needle bed, to be superposed on the back side of the stitch of the front body 2*a* at the lateral end thereof on the sleeve side. In the courses 10 and 11, the yarn is fed to the needles G-L of the front needle bed, to form the course sequent to the front body 2*a*. In the sequent course 12, the stitches of the front body 2*a* are transferred to the TR jacks g-l of the back TR jack bed. In the course 13 of FIG. 8, after the back TR jack bed is racked rightwards by one pitch, the stitches of the front body 2*a* are transferred to the needles F-K of the front needle bed. In the course 14, the back needle bed is racked leftwards by one pitch, the stitch of the back sleeve 4*b* retained on the needle K of the back needle bed is transferred to the front needle bed, to be superposed on the back side of the stitch of the front body 2*a*. In the courses 15 and 16 of FIG. 8, the yarn is fed to the needles F-K of the front needle bed, to knit the front body 2*a*. Thereafter, the knitting steps illustrated from the course 12 of FIG. 7 to the course 16 of FIG. 8 are repeated to join the front body 2*a* and the back sleeve 4*b* that is formed on the opposite side with respect to the shoulder line 15 and, as a result of this, the state is presented in which the stitches of the front body 2*a* and the stitches of the back body 2*b* are only formed, as illustrated in the course 17. Sequentially, the front body 2*a* and the back body 2*b* are joined by the processes disclosed by Japanese laid-open (unexamined) patent publication No. Hei 9-273, 051 to complete the knitting of the sweater 1.

As mentioned above, according to the knitting method of the embodiment, there is no need to transfer the stitches of the sleeve 4, which is completed in the knitting and forms no new stitches, toward the front body 2*a* when the front body 2*a* and the sleeve 4 are joined. Thus, when a weak yarn is used for the knitting or when the knitting is performed by use of the flat knitting machine with fine gauges, possible yarn breakage and like problems can be avoided. Also, when the front body 2*a* is shifted to the sleeve 4 to be joined to it, the stitch of the front body 2*a* shifted is superposed on the front side of the stitch of the sleeve 4, rather than on the back side of the stitch of the sleeve 4, to be joined thereto. This can produce an armhole line of good appearance with the stitches of the front body 2*a* shifted appearing on the front side of the knitted fabric. The above-illustrated embodiment adopts the process that when the front body 2*a* is shifted toward the sleeve 4 to be joined to it, the stitch of the sleeve 4 at the lateral end thereof on the body side is superposed on the stitch of the front body 2*a* and thereafter the stitch of the front body 2*a* is shifted toward the sleeve 4, whereby the stitch of the body is superposed on the front side of the stitch of the sleeve. It may adopt another process that the stitch of the sleeve 4 to be superposed on the stitch of the front body 2*a* is transferred in advance to the TR jack before the front body 2*a* is shifted toward the sleeve 4 and, thereafter, the body is shifted toward the sleeve and then the stitch of the sleeve 4 is retransferred to superpose the stitch of the body 2*a* on the front side of the stitch of the sleeve 4.

Also, the above-noted embodiment adopts the process that after completion of the knitting of the sleeve 4, the front body 2*a* is shifted to the sleeve to be joined to it. It may adopt another process that the sleeve 4 as is completed in the knitting is shifted toward the front body 2*a* to the extent to which burden is not applied to the stitches of the sleeve. While the embodiment in which the bodies 2*a*, 2*b* and the sleeve 4 are knitted with a plain knitting structure has been described in the above, in the case where the four-bed flat knitting machine having another pair of upper needle beds instead of the transfer jack beds or empty needles, interposed between the needles used for forming the stitches, for transferring the stitches are used for the knitting, the combined knitting structure in which face stitches and back stitches are mixed, such as links, garter stitch and rib stitch, can be formed.

CAPABILITIES OF EXPLOITATION IN INDUSTRY

As mentioned above, according to the knit clothing knitting method of the present invention, when the tubular body and the tubular sleeves are joined and knitted in the form of one tubular body and also one body knitted to be longer than the other body is joined to the sleeve as is completed in the knitting, so as to knit the knitted fabric having a silhouette of the one body extending beyond the shoulder line into the other body, the body for which the stitches of the next course is sequentially formed is shifted toward the sleeve and the neckline to be jointed thereto. In addition, when the stitches of the body are superposed on the stitches of the sleeves, the stitches of the body are superposed and joined to the stitches of the sleeves in such a manner as to appear on the front side of the stitches of the sleeves. Hence, when a weak yarn is used for the knitting or when the knitting is performed by use of the flat knitting machine with fine gauges, the knitting can be done without worry about the possibility of yarn breakage. In addition to this, the knit clothing of high commercial value having an armhole line of good appearance with the stitches of the body appearing on the front side of the stitches of the sleeves can be knitted.

What is claimed is:

1. A knitting method for knit clothing using a flat knitting machine having at least a pair of front and back needle beds arranged in opposition to each other, wherein after a tubular body, into which a first body and a second body are knitted in their overlapped state, and right and left tubular sleeves, each of which is knitted in the state in which both front and back sides are overlapped with each other, are knitted from hems to armpits, the sleeves and the body are joined, the knitting method comprising the steps:

1) that the first and second bodies and the right and left sleeves are knitted into one tubular body;

2) that a neckline is formed in at least one of the first and second bodies during the step 1;

3) that the sleeves are shifted toward the body so that the body and the sleeves are joined at the armhole;

4) that a course knitting for the sleeves and the first body is completed, followed by proceeding with a course knitting for the remaining second body;

5) that the second body for which the course knitting proceeds in the step 4 is knitted up to a shoulder line, during which the second body is shifted toward the sleeve and the second body and the sleeve which is formed on the same side with respect to the shoulder line are joined at their joining portion in such a manner that the stitches of the second body can appear on the front side of the stitches of the sleeve;

6) that the second body for which the course knitting proceeds is knitted beyond the shoulder line, during which the second body is shifted toward the neckline and the second body and the sleeve which is formed on the opposite side to the sleeve joined in the step 5 with respect to the shoulder line are joined; and 7) that the first body and the second body are joined at the shoulder.

2. The knitting method for knit clothing as set forth in claim 1, wherein the step that the body is shifted toward the sleeve and the body and the sleeve are joined in such a manner that the stitches of the body can appear on the front side of the stitches of the sleeve includes the steps:

1) that the stitch of the sleeve at a lateral end thereof on the body side is transferred toward the stitch of the body at a lateral end thereof on the sleeve side, to superpose the stitch of the sleeve on the back side of the stitch of the body; and 2) that the body is shifted toward the sleeve.

* * * * *